United States Patent [19]

Richards

[11] Patent Number: 4,557,248

[45] Date of Patent: Dec. 10, 1985

[54] WOOD AND GAS FIRED FURNACE

[76] Inventor: James A. Richards, 1718 Fairview, Wichita, Kans. 67202

[21] Appl. No.: 689,439

[22] Filed: Jan. 7, 1985

[51] Int. Cl.[4] ..... F24H 9/18; F23K 3/00

[52] U.S. Cl. ..... 126/107; 126/152 B; 126/152 R; 126/85 R; 126/245; 126/110 R; 126/99 A; 110/101 C; 110/101 CC; 237/52; 237/53

[58] Field of Search ..... 126/124, 107, 10, 68, 126/73, 152 B, 127, 152 R, 85 R, 245, 242, 121, 99 R, 110 R, 110 A, 99 A; 110/189, 186, 289, 291, 327, 101 CD, 101 CC, 101 C; 237/52, 53

[56] References Cited

U.S. PATENT DOCUMENTS

| | | | |
|---|---|---|---|
| 494,809 | 4/1893 | Hilton | 110/101 CC |
| 686,500 | 11/1901 | Adams et al. | 126/242 |
| 874,188 | 12/1907 | Hamel et al. | 126/242 |
| 1,335,265 | 3/1920 | Zamernik | 110/101 CC |
| 4,126,119 | 11/1978 | Fike | 126/107 X |
| 4,201,187 | 5/1980 | Skow | 126/99 A X |
| 4,315,468 | 2/1982 | Tyer et al. . | |
| 4,321,879 | 3/1982 | Toivo . | |
| 4,339,998 | 7/1982 | Finch | 110/101 CC X |
| 4,409,955 | 10/1983 | Christian | 126/99 A X |
| 4,442,825 | 4/1984 | Waldau | 110/101 CD X |
| 4,480,630 | 11/1984 | Wilhoite | 126/99 R X |
| 4,503,782 | 3/1985 | Helton | 126/152 B X |

*Primary Examiner*—Randall L. Green

*Attorney, Agent, or Firm*—Kokjer, Kircher, Bradley, Wharton, Bowman & Johnson

[57] ABSTRACT

A furnace for wood log fuel having apparatus which automatically inserts the logs into the furnace combustion chamber. The log fuel is retained in a sloping ramp storage compartment. Electrical circuitry controlled by a thermostat operates to move a log into an elongated chamber from which a motor driven injector pushes the log into the combustion chamber through a doorway covered by a flexible, segmented flap covering and also a door which is pushed open by the advancing log. The presence of the log on a spring mounted grate operates certain switches to return the injection mechanism to its ready condition and also to operate a fan which provides combustion air to the combustion chamber. The reduced weight on the grate by the consumption of the log by the fire permits the grate to move to a position to re-initiate the log injection cycle. A standby gas fuel burner system is also provided and is controlled by the thermostat to operate when the log fuel heat is insufficient, such as upon the supply of log fuel becoming exhausted. An optional auger conveyor which operates under the control of dual timers for automatic discharge of ashes from the furnace is also disclosed.

17 Claims, 10 Drawing Figures

WOOD AND GAS FIRED FURNACE

This invention relates to furnaces, and more particularly to a furnace primarily for burning logs and having a back up capability for burning gas.

Energy shortages have generated renewed interest in fuel sources other than gas, oil and electricity. Wood is often resorted to as a fuel for household heating use. Wood is generally readily available and its cost relative to other commonly used fuels makes it attractive for use for heating purposes.

Modern technology has made it possible for wood, as a by-product from a variety of fabrication and construction projects, to be made avaliable for use as fuel. Conveniently sized, cylindrical artificial logs can be manufactured from saw dust or from various scraps of wood which have heretofore been wasted. Logs of this type may also be combined with suitable constituents to assure controlled, relatively uniform combustion. All of these factors have contributed in making wood logs an economical alternate to fossil fuels as a source of heat.

One major drawback with wood logs for fuel has been the substantial inconvenience attendant upon their use. Conventional wood burning stoves and furnaces have heretofore required substantial operator attention. Combustion considerations dictate that only a relatively small number of logs be placed in the combustion chamber at any given time. This results in the necessity for the operator to add additional logs to the fire at relatively frequent intervals.

The task of charging a wood burning furnace with fuel has typically been hazardous and inconvenient. The operator is often exposed to the dangers of direct contact with the flames. Soot and smoke frequently escape from the fire box when fuel is added. The clothing of the operator is likely to become damaged or soiled from the products of combustion in the process.

Accordingly, it is a primary object of this invention to provide a log burning furnace which overcomes the foregoing disadvantages in that it is refueled automatically without the need for constant operator attention.

Another important object of the present invention is to provide a wood fuel furnace having standby facilities for utilizing alternate fuel for emergencies, yet which is highly efficient and may be operated primarily with electric controls to minimize the safety hazards normally associated with the use of a furnace of this general type.

Still another object of the present invention is to provide in a furnace of this kind an improved apparatus for removal of the wood fuel ash, thereby enhancing the convenience of furnace operation.

These and other important aims and objectives of the present invention will be further explained or will become apparent from the following description and explanation of the drawings, wherein.

Figure 2:
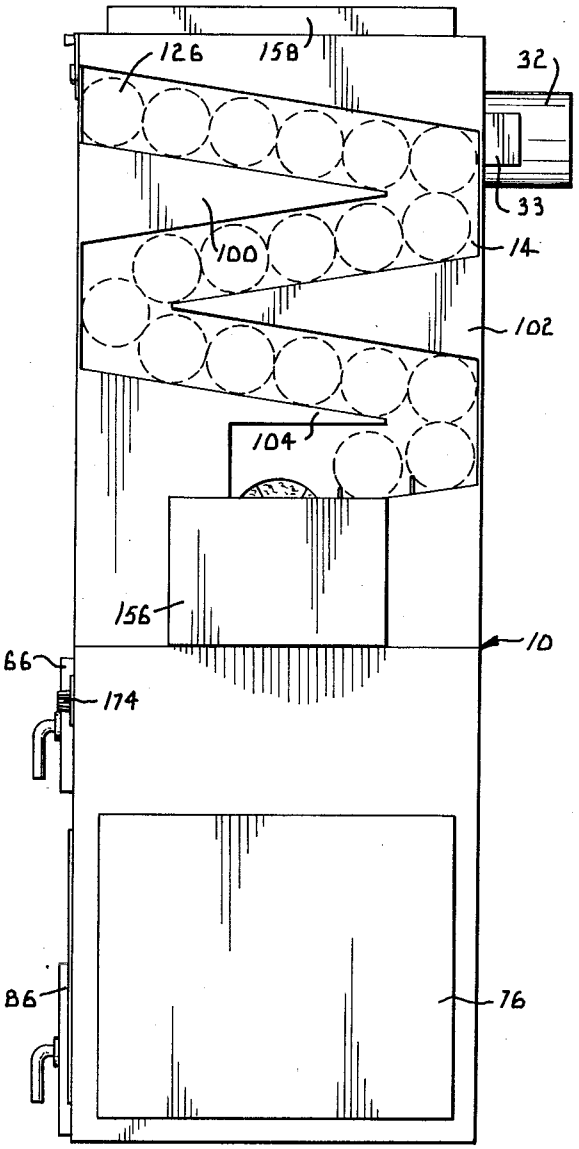
FIG. 2 is a side elevational view thereof, the supply of wood logs being shown in phantom for clarity.

A furnace embodying the principles of this invention is broadly designated by the reference numeral 10 and includes a combustion chamber 12, a log supply section 14, an air chamber 16, and a housing 18 for the controls for the unit. Combustion chamber 12 is defined by a shroud 20 illustrated best in FIGS. 3 and 4 of the drawing. Shroud 20 encloses the combustion chamber and is spaced inwardly from the outer wall 22 of furnace 10. Outerwall 22 may be advantageously insulated to minimize the undesirable loss of heat from the furnace. A suitable insulation, such as any of a number of commercially available, aluminum backed insulation materials may be glued or otherwise secured to the inner surface of wall 22 with the aluminum side facing inwardly. The insulation has been omitted from the drawings for purposes of clarity.

The top of chamber 12 communicates with a heat exchanger 24 as shown in the drawing. Thus, the open top of chamber 12 is in fluid communication with a plurality of horizontally extending, transversely rectangular, tubular receivers 26 which, in turn, communicate with an elongated, upper manifold 28 by a plurality of spaced apart, tubular columns 30 in the manner illustrated. Manifold 28 extends outwardly through the proximal furnace outer wall 22 to provide a vent 32 adapted to be connected with a chimney or flue. A damper 34 is positioned in vent 32 and is operated by a motor 33 as will be readily understood by those skilled in the art.

Figure 7:
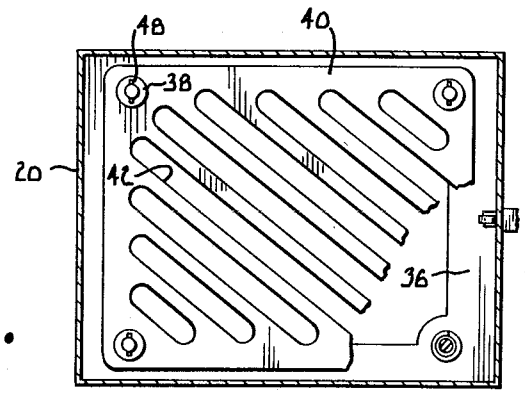
FIG. 7 is a detailed cross-sectional view taken along line 7—7 of FIG. 3 showing a top plan view of the furnace grate, parts being broken away to reveal details of construction.

The open bottom of combustion chamber 12 is defined by an inwardly extending, peripheral flange 36 shown best in FIG. 7 of the drawing. Each corner of flange 36 rigidly mounts a vertically upwardly extending elongated, transversely circular rod 38. Rods 38 provide the monting and guidance for a generally horizontally extending, rigid rectangular grate 40 having a plurality of elongated, spaced apart slots 42 formed therein as illustrated in FIG. 7. Preferably, slots 42 are oriented diagonally of the rectangular grate 40 as shown to minimize the opportunity for log embers to fall through the grate. Grate 40 has a hole through each corner of the grate and each hole is adapted to receive a respective one of the vertical rods 38 through the hole to permit the grate to slide up and down along the rods with the grate maintained in horizontal disposition. Each rod has a spring 44 telescoped over the rod beneath the grate. The respective springs 44 bias the grate upwardly to the uppermost end of its path of travel, the latter being defined by a washer 46 telescoped over each respective rod 38 and retained by respective cotter pins 48. Each rod 38 is provided with a series of transversely extending, vertically spaced apart holes 50 to permit vertical adjustment of the positions of the washer and cotter pins assemblies.

The rod receiving holes in grate 40 are sufficiently larger than the respective rods 38 to permit the grate to shake somewhat when a log is deposited on the grate. This shaking of the grate has a tendency to cause any ashes which tend to collect on the grate to gravitate through the slots 42.

A plurality of horizontally spaced apart rods 52 extend transversely across combustion chamber 12 proximal the upper end of the latter and support thereon a burner 54 design for either natural gas or liquefied petroleum gas fuel. Burner 54 is connected by a pipe 56 with a source of such gas. Suitable pilot apparatus 60, such as an electric pilot apparatus, is operably coupled with burner 54 for operating the latter as an auxiliary heat source as will be more fully hereinafter described. A plurality of deflector plates 62 are mounted on rods 52 immediately beneath the major components of burner 54. Deflector plates 62 are located in a position to deflect the products of combustion from wood fuel on grate 40 back downwardly into the combustion chamber for more complete burning of the latter. Further, the plates 62 protect the components of the gas burner 54 from soot, resin and other products of combustion which could otherwise foul the burner.

Figure 4:
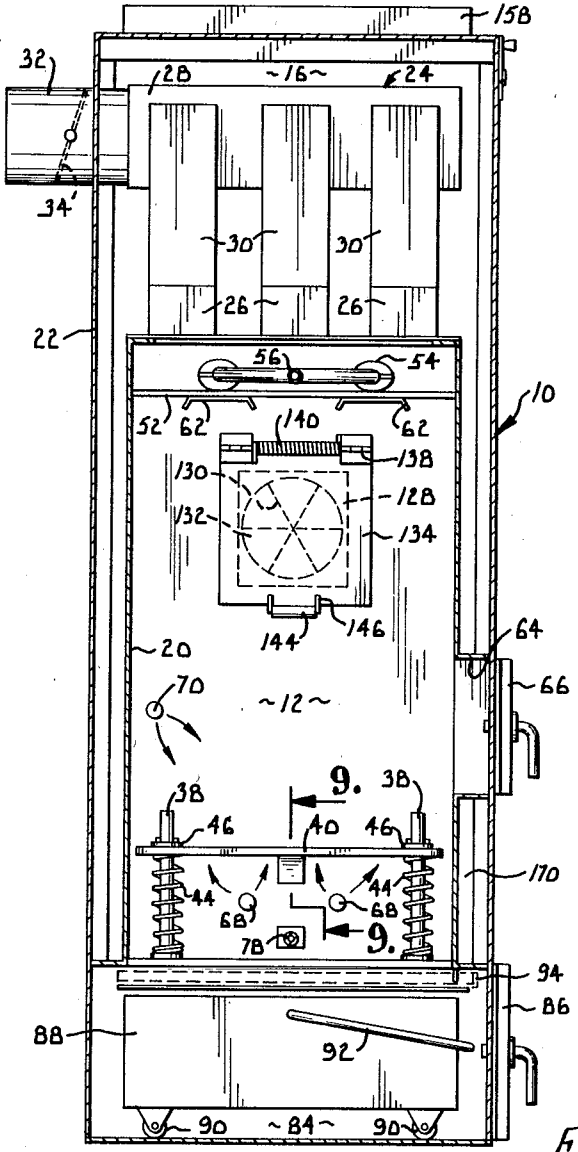
FIG. 4 is a detailed cross-sectional view taken along line 4—4 of FIG. 3.

An access opening 64 in shroud 20 is normally closed by an openable access door 66 as shown in FIG. 4. Door 66 not only provides convenient access to the combustion chamber for purposes of inspection, repairs, and the like, but it also provides a means through which natural logs may be used with the furnace if desired. Although manufactured logs are contemplated as the primary fuel for the furnace natural logs can be manually placed into the furnace through opening 64 in case the supply of manufactured logs becomes exhausted, or when it is desired for any reason to utilize natural logs as the furnace fuel. Door 66 is provided with a suitable gasket or seal such as a ceramic rope insulation seal which mates with the periphery of opening 64 when the door is closed. This insures that no products of combustion are inadvertently permitted to escape from the combustion chamber and that uncontrolled air is not admitted through the opening.

Figure 3:
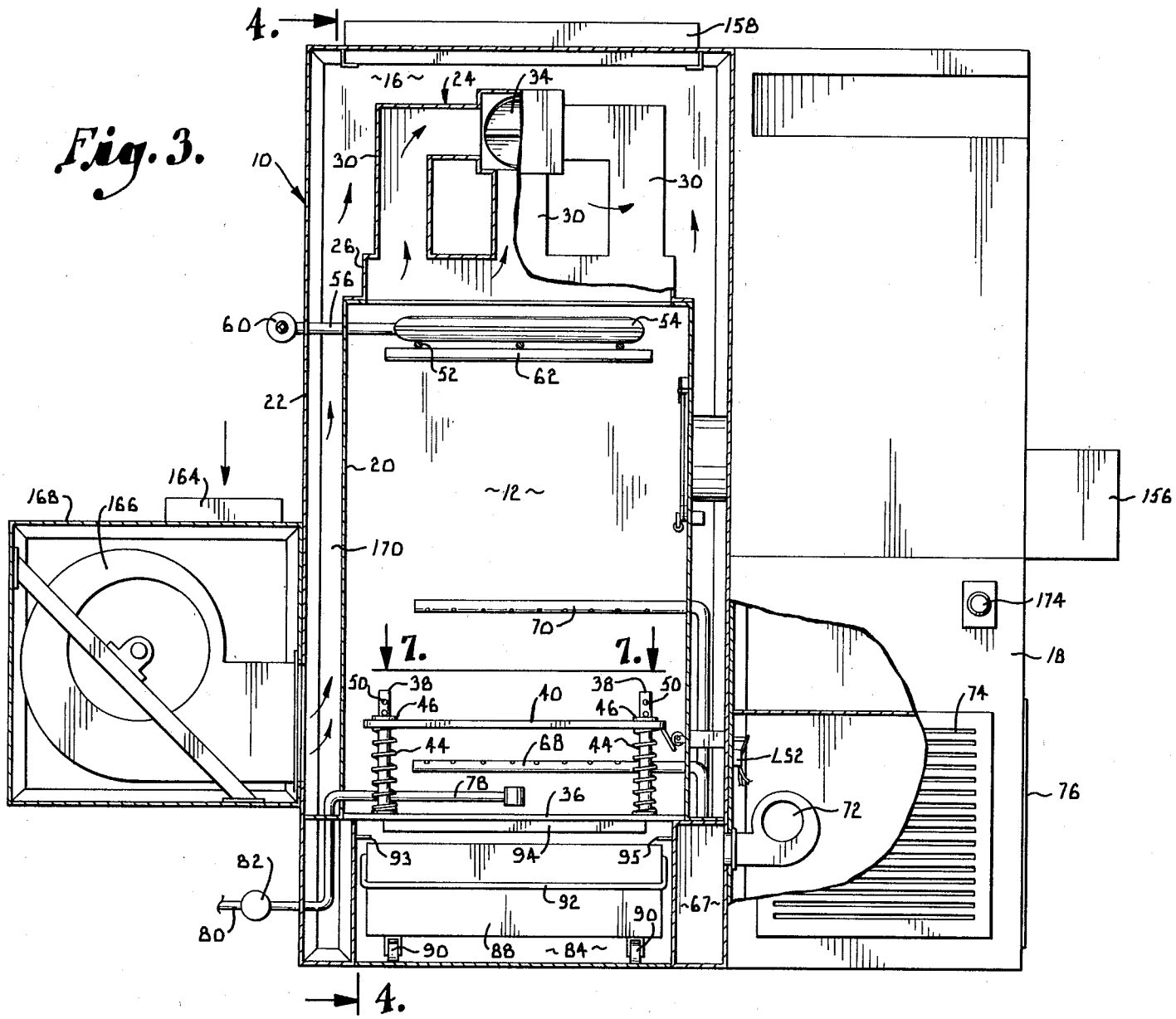
FIG. 3 is a front elevational view thereof, parts being broken away and shown in cross-section to reveal details of construction.

Oxygen for the combustion in chamber 12 is provided by means of a pair of perforated air tubes 68 and 70 connected to an air reservoir 67 supplied by a fan 72 as best shown in FIG. 3. The air which is blown by fan 72 ultimately into the combustion chamber is drawn in through a grill 74 in one side of housing 18. The latter also has a removable panel 76 to provide ready access to the electrical controls for the furnace which are located within housing 18.

A log lighter 78 is positioned in combustion chamber 12 immediately beneath grate 40 and communicates with an external source 80 of fuel such as natural gas or liquified petroleum gas. A valve 82 permits selective manual operation of the log lighter 78 as may be desired.

An ash chamber 84 is positioned in furnace 10 immediately beneath the open bottom of combustion chamber 12. The bottom and three sides of chamber 84 is closed by the exterior furnace wall 22. The front of the chamber is normally closed by an openable door 86 to permit the insertion and removal of an ash receptacle in the form of an open top ash wagon 88. The wagon 88 is supported by four caster rollers 90. A bail or carrying handle 92 is swingably affixed to wagon 88 to permit the convenient insertion and removal of the wagon 88 into and from chamber 84. Handle 92 also permits the wagon to be carried if desired. It should be noted in FIGS. 3 and 4 of the drawing that a flange 94 depends from the portion of flange 36 at the base of combustion chamber 12 adjacent the ash compartment access door 86. A tray (not shown) having a flat bottom and an upturned edge extending around three sides to form front and side walls of the tray is installed beneath the grate by sliding on spaced apart, elongated, parallel rails 93 and 95 projecting inwardly from the side walls of the ash chamber. The tray is normally not positioned on the rails. It is, however installed when the ash wagon 88 is removed for emptying. This permits the ashes to gravitate onto the tray where they are caught and retained when the ash wagon is absent from its usual position.

After the ash wagon is again replaced into the position shown, the tray is removed to permit direct gravitation of the ashes into the wagon. Flange 94 is positioned relative to the tray to drag any ashes which have accumulated on the tray during the interval off the tray and discharge them onto the ash wagon.

The log supply section 14 of furnace 10 includes a elongated ramp which extends in zig zag fashion from a top opening or slot 96 in the front face of the furnace to a log injection chamber 98 from whence the logs are injected laterally into combustion chamber 12. The supply ramp includes a plurality of inwardly directed alternately oppositely extending wedge sections 100, 102 and 104 cantilevered from the front and rear walls of the furnace as illustrated best in FIGS. 1 and 2 of the drawing. The upper and lower surfaces of the sections 100, 102 and 104 are both angled to present a generally uniform, zig zag slot for the storage of logs as illustrated in FIG. 2.

Figure 1:
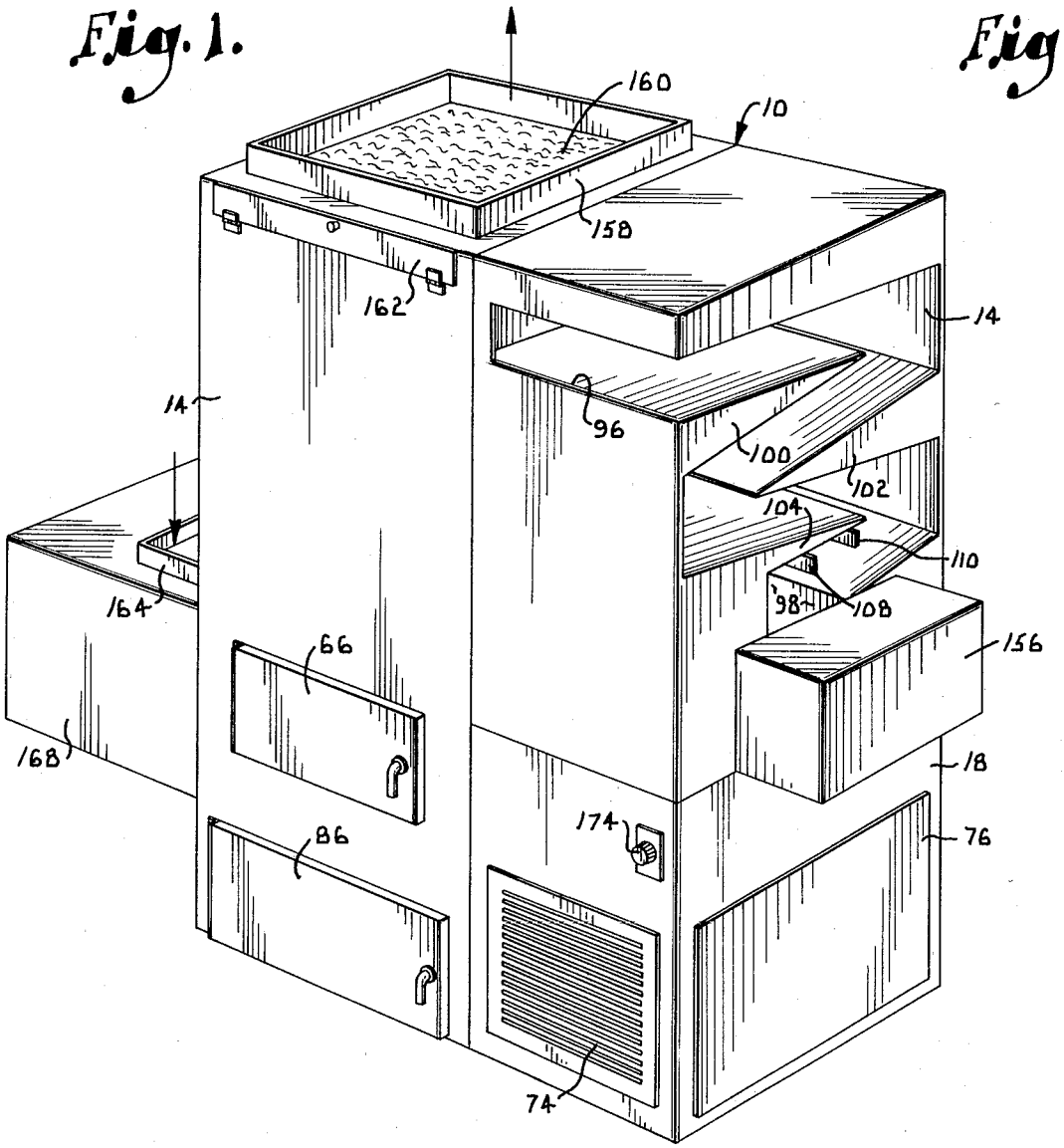
FIG. 1 is a front perspective view, on a reduced scale, of a furnace embodying the principles of this invention.
Figure 6:
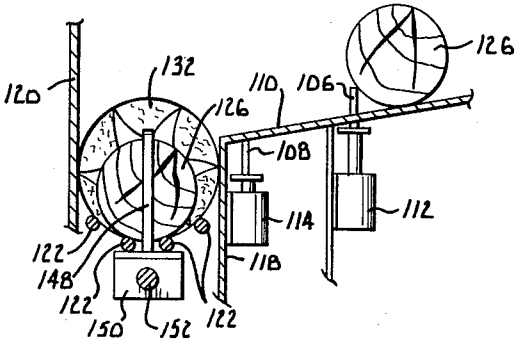
FIG. 6 is a detailed cross-sectional view taken along line 6—6 of FIG. 5.

A pair of horizontally extending, parallel, elongated rigid barriers 106 and 108 are mutually spaced apart along a lowermost ramp section 110 as shown in FIGS. 1 and 6 of the drawing. The barriers 106 and 108 are operated by solenoids 112 and 114 for shifting the barriers between the extreme uppermost positions blocking the rolling of logs down the ramp and to the retracted positions permitting such rolling.

Manifestly, the ramp is adapted to accommodate a series of side by side, cylindrical logs 126 as shown in FIG. 2. While any cylincrical logs could be accommodated, most natural wood logs would not be sufficiently cylindrical in shape to roll satisfactorily down a ramp of the kind involved here. On the other hand, logs of the type which are commonly manufactured from saw dust, scrap wood from manufacturing process and like materials and sold commercially for use as fuel are sufficiently cylindrical for this purpose. Such "man made" logs are the fuel intended for use in furnace 10.

In addition to the barriers 106 and 108, means for inserting the logs into the combustion chamber includes the elongated log injection chamber or chute 98 immediately adjacent the lowermost end of ramp section 110. Chamber 98 is defined by a vertical extending wall segment 118 proximal the lowermost barrier 108 on ramp 110, and a second vertical wall 120 spaced horizontally from segment 118 as shown best in FIG. 6. Chute 98 also includes a plurality of transversely circular rods or bars 122 disposed in semicircular fashion as shown in FIG. 6 and extending longitudinally of chute 98.

The end of chute 98 proximal combustion chamber 12 communicates with the latter through a log feed tube or pipe 124 which is of substantially larger diameter than the diameters of the respective logs 126. It should be noted in FIG. 5 of the drawing that the bottom of the circular pipe 124 is generaly contiguous with the arc defined by the ends of the respective elongated rods 122 defining the injection chute. Thus, the upper portion of pipe 124 is substantially spaced above the upper surface of a log 126 passing through the pipe. Pipe 124 provides communication to the interior of chamber 12 through shroud 20 and through the proximal wall of the furnace as illustrated in the drawings.

Figure 5:
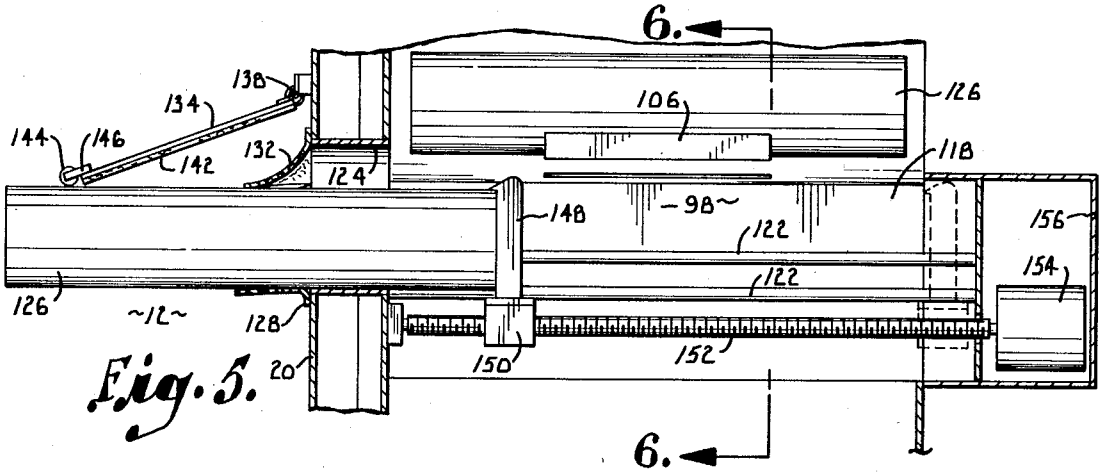
FIG. 5 is an enlarged, fragmentary elevational view of the log feeder for the furnace illustrating a log partially inserted into the combustion chamber, certain parts being broken away and appearing in cross-section to reveal details of construction.

The opening in the furnace shroud 20 proximal pipe 124 is normally closed by a flexible fiber cloth cover 128 of fire resistant material. Cover 128 may be seen in FIGS. 4 and 5 of the drawing as comprising a sheet of such material secured in covering relationship over the shroud opening and having a plurality of elongated slits 130 which proceed radially outwardly from the center of the opening to present a plurality of pie shaped flaps 132. The flaps 132 have sufficient resiliency to normally cover the opening closely adjacent the plane of the shroud wall but also have enough flexibility so that they may be pushed aside by a log advancing longitudinally of the injection chute 98 as shown in FIG. 5. The flaps 132 insure that substantially all of the products of combustion in chamber 12 remain in the combustion chamber, even during the injection of a log into the latter.

As additional insurance against the inadvertent egress of the products of combustion and the loss of heat from the combustion chamber 12, the log injection opening is also provided with a door 134 normally covering the fiber cloth cover. Door 134 is mounted to the shroud 20 of chamber 12 by an elongated hinge 138 and is biased to its closed position by a spring 140. It may be noted in FIG. 5 that hinge 138 is mounted slightly outwardly from the proximal surface of the combustion chamber shroud 20 to permit door 134 to assume a fully closed position over flaps 132 and to accommodate a peripheral door seal 142 of fiber rope of the like adapted to sealingly engage the inner surface of the shroud when the door is closed. An elongated, preferably ceramic roller 144 is mounted to the lowermost edge of door 134 in projecting relationship therefrom by a bracket 146 as illustrated in FIGS. 4 and 5. FIG. 5 shows the manner in which the ceramic roller 144 engages the outer surface of a log 126 when the latter is injected into the combustion chamber, causing the door to swing open against the bias of spring 140.

Means for injecting a log longitudinally into the combustion chamber when a log is deposited in the injection chute 98 also includes an elongated element 148 rigidly secured to a follower 150 and projecting upwardly in the chute. Follower 150 is internally threaded and is reciprocated along an elongated rotatable externally threaded rod 152 which is mounted to be turned on its longitudinal axis by a reversible, electrically driven motor 154. It will be apparent that when rod 152 is rotated in one direction, follower 150 moves element 148 to the left as viewed in FIG. 5. Conversely, when the motor rotates the rod in the opposite direction, the follower and element are moved to the right. Motor 154 is contained within a housing 156 located exteriorly of the main furnace housing.

An opening in the top of air chamber 16 is bounded by a peripheral flange 158 providing an adapter for connection with the ductwork of the structure to be heated with furnace 10. A filter 160 is supported in position covering the opening defined by flange 158 and may be easily installed and removed through a filter access door 162 in the front of the furnace 10.

Air returning from the structure ductwork to be heated by furnace 10 is conducted through an inlet flange 164 to a squirrel cage fan 166 in a fan housing 168. Fan 166 discharges air into the space 170 around combustion chamber shroud 20 and inside the outer furnace wall 22. The air is thus heated as it flows through space 170 and into the air chamber 16 for further heating by heat exchanger 24 before it is discharged through filter 160 into the building ductwork.

Figure 8:
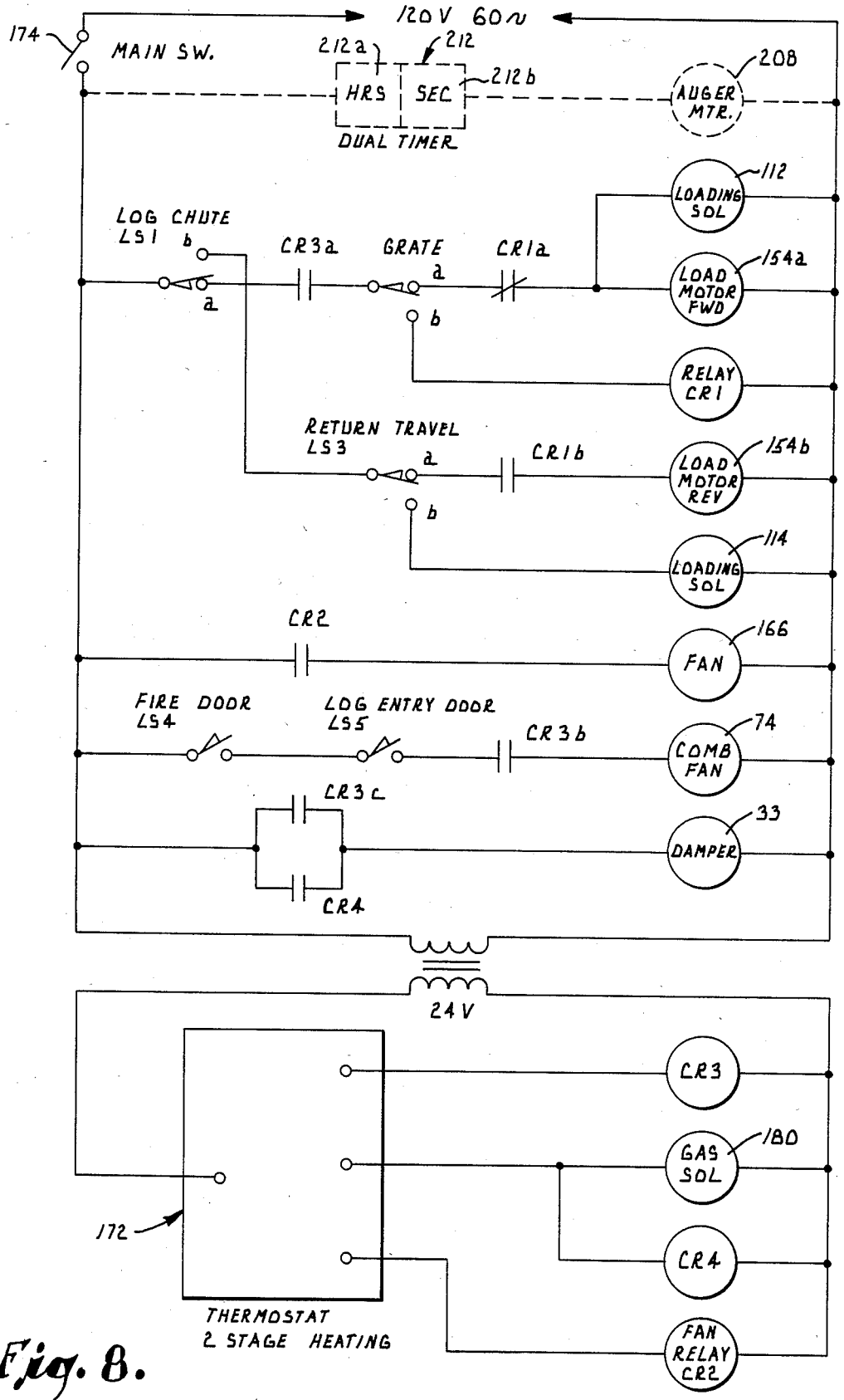
FIG. 8 is a simplified diagram of the electrical circuitry utilized with the furnace.

FIG. 8 of the drawing is a simplified wiring diagram illustrating the controls used to operate furnace 10. A substantial number of these electrical controls are physically housed within the furnace housing 18. Others such as limit switches and sensing switches and the like are positioned as necessary for advantageously performing the functions required. The furnace controls can best be described in connection with an explanation of the operation of the furnace and the interrelationship of the components as illustrated in the drawing will be readily apparent to those skilled in the art.

The operation of the furnace is under the control of a thermostat 172 providing a two stage heating circuit, one circuit for log fuel and the other for gas fuel, facilities for operating an air conditioning unit could also be installed and operated in conjunction with furnace 10 if desired.

It may be assumed that initially the main switch 174 located on the front housing of furnace 10 (FIG. 1) is in its open or "off" position and a log is resting in the log loading chute or injection chamber 98. A single pole double throw limit switch LS1 located in injection chamber 98 is held in the position closing contact "a" of the switch by virtue of the physical presence of the log in the chamber engaging the switch.

The automatic operation of the furnace is initiated by manually closing main switch 174. Assuming thermostat 172 calls for heating due to the level of the ambient temperature at the thermostat location, the thermostat energizes a relay coil CR3 which operates a three pole single throw normally open multiple switch. This closes the switches CR3*a*, CR3*b* and CR3*c*.

Figure 9:
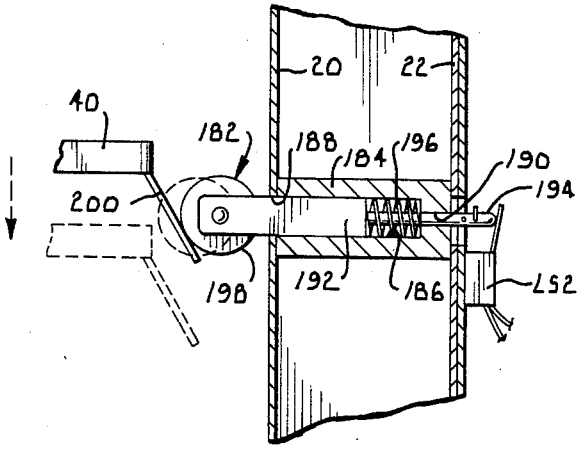
FIG. 9 is an enlarged, detailed fragmentary horizontal cross-sectional view through the furnace illustrating the grate switch operating assembly.

The closing of switch CR3*a* completes a circuit to the windings 154*a* of motor 154 for the "forward" direction of the motor through a single pole double throw limit switch LS2 which is physically located in compartment 18, but is operated by grate 40 by an operator assembly 182 best illustrated in FIG. 9 of the drawing. Assembly 182 includes an elongated housing 184 secured to the outer surface of wall 20 and substantially spanning the distance between the latter and wall 22. An elongated bore 186 communicates one end of housing 184 with an opening 188 in wall 20, and a bore section 190 of substantially lesser diameter communicates with the opposite end of the housing. A piston 192 having an integral projection 194 of lesser diameter is telescoped in bore 186 with projection 194 extending through bore section 190 and an aligned hole in wall 22.

A coil spring 196 in bore 186 is telescoped over projection 194 to bias the piston to the leg as viewed in FIG. 9. A roller 198 is rotatably mounted on the end of piston 192 which projects into the combustion chamber and roller 198 is positioned to be engaged by a cam plate 200 which is rigidly secured to one edge of grate 40 and depends therefrom at an angle as shown.

When plate 200 is carried by the grate to the uppermost end of its path of travel, engagement of the plate against roller 198 forces piston 192 to slide in the direction counteracting the bias of spring 196, thereby advancing projection 194 beyond wall 22 sufficiently for engaging and operating the LS2 switch. Conversely, when grate 40 is moved downwardly on its path of travel under the influence of a log resting on the grate, plate 200 is moved to permit piston 192 to slide under the influence of spring 196 sufficiently to disengage projection 194 from the LS2 switch. This permits the switch to resume its unoperated condition.

When the LS2 switch is engaged by projection 194, the switch contact "a" is closed. Movement of the grate down from this uppermost position causes the LS2 switch to open its contact "a" and close its contact "b". The circuit to energize motor 154 is further completed through the closing of a double pole single throw switch CR1*a* operated by relay CR1.

Relay switch CR3*b* completes the circuit to the combustion fan 74. A switch LS4, physically located proximal door 66, is closed when the door into the combustion chamber is closed. Further, a switch LS5, physically positioned to be operated by the swinging of door 134, is closed when the log entry door 134 is closed. The switches LS4 and LS5 serve as safety devices to insure that fan 72 which provides air for combustion of the fuel in the combustion chamber cannot be operated when either of these doors are in their open positions. This minimizes fire hazards and the possibility for the inadvertent escape of products of combustion when the chamber is not fully closed.

The energizing of motor winding 154*a* causes the motor to turn in its forward direction and moves element 148 to the left as viewed in FIG. 5. This pushes log 126 in the injection chamber through the flaps 132 of the fiber cloth cover 128 and into engagement with door 134, swinging the latter open. The opening of door 134 opens switch LS5, turning fan 174 off. Motor 154 continues to drive follower 150 and element 148 until the log is pushed far enough to drop into the combustion chamber and onto grate 40. When the log drops into the fire chamber, the entry door 134 closes thereby closing switch LS5 reenergizing combustion fan 74. Solenoid switch CR3*c* also closes at this time to energize damper motor 33.

The downward movement of grate 40 under the weight of the log causes switch LS2 is to be moved to the position closing contact "b" and operating the CR1 relay. This results in opening switch CR1*a* and closing switch CR1*b*. The closing of switch CR1*b* completes a circuit to the motor windings 154*b* which reverses the direction of operation of motor 154. A return travel limit switch LS3 is physically positioned to be engaged by the screw driven follower 150 when the motor has fully returned to the position shown in dash lines in FIG. 5. The contact "b" of switch LS3 is thereby closed, operating solenoid 114 in a manner to retract barrier 108 allowing another log to drop into the log loading chute. This closes switch LS1*a* which will release solenoid 112 to permit barrier 108 to resume its extended position.

As the log is consumed, the weight of the log on the grate lessens, allowing the grate to again return to its uppermost position under the bias of springs 44. When the upward movement of the grate is sufficient to move switch LS2 to the position closing contact a of the switch the foregoing operation is repeated. The closing of switch LS2*a* also energizes solenoid 112 to withdraw barrier 106 allowing another log to roll into position against barrier 108 and thus in a ready position for subsequent loading into the log injection chute.

It will be understood that the sequence of events heretofore described are automatically repeated in a manner wherein the logs in the supply ramp are successively injected into the furnace combustion chanber in accordance with the consumption of a previous log and the temperature requirements as sensed by thermostat 172. The heated air distribution fan 166 is, of course, controlled from thermostat 172 for either cyclic operation determined by the temperature of the air in the vicinity of the furnace heat exchanger, or, if desired by a thermostat switch position providing for continuous fan operation.

In the event the heat provided by the burning of the logs in the combustion chamber should be insufficient to fulfill the requirements dictated by the thermostat setting, then stage two of thermostat 172 completes a circuit from the thermostat to energize solenoid 180. This solenoid opens the supply of gas fuel to burners 54 which is ignited by conventional electric pilot lighting means. The latter is entirely conventional, forms no part of the present invention per se, and need not be described in detail.

When gas fuel is supplied to the furnace as described, relay CR4 is also energized to close its corresponding switch CR4, thereby energizing damper motor 33. Thus, for example, if the reason the log fuel heat has been insufficient to prevent the activation of the back up gas fuel system is because no logs are in the supply ramp, the damper may still operate as a control over the discharge of the combustion gases from the furnace.

It should be pointed out that the damper motor 33 is temperature controlled. Once the motor is energized, the setting of the damper is adjusted by the motor in accordance with the heat in the upper region of furnace 10. This automatic operation of the damper vane adjustment is entirely conventional and need not be described in detail.

Figure 10:
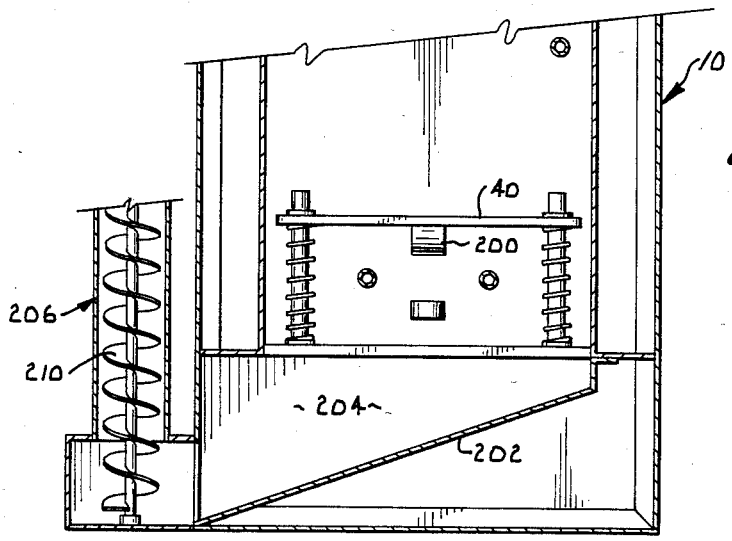
FIG. 10 is a fragmentary, detailed vertical cross-sectional view through the furnace an alternate embodiment incorporating an auger conveyor ash disposal system.

FIG. 10 of the drawings illustrates a modification of furnace 10 wherein the ash wagon system of ash removal is replaced with an auger conveyor system for even more convenient operation. In the FIG. 10 embodiment, the ash wagon 88 is not used. Instead, the ash compartment of furnace 10 is fitted with a generally sloping partition 202 to present an ash hopper 204 in the ash compartment of the furnace. An opening (not shown) in the compartment wall communicates with a discharge auger conveyor 206.

Motor 208 (FIG. 8) for driving the auger 210 of conveyor 208 is electrically connected in series for control by a dual timer 212 as shown in FIG. 8. Timer 212, has a section 212*a* which controls by means of an internal switch the internal at which another timer section 212*b* operates. Section 212*b* controls an internal electrical switch to govern the period of time the motor is energized at the end of each elapsed interval as controlled by section 212*a*.

Conveyor 206 may, of course, be of any length desired. It is contemplated that a flexible metal hose (not shown) may be attached to the outermost end of the conveyor to conduct the ashes to any suitable container such as an air tight metal box which may be positioned exteriorally of the furnace such as behind or closely adjacent the latter.

In the operation of the embodiment shown in FIG. 10, timer section 212*a* is manually set to electrically connect timer section 212*b* into the circuit shown in this figure of the drawing at whatever time interval may be desired. If, for example, experience or judgement indicates that the operator wishes to have the ashes emptied at twelve hour intervals, timer section 212*a* is manually set at this interval. The interval chosen and set on section 212*a* can, of course, be greater or less if desired. Timer section 212*b* is then manually set at the length of time that it is anticipated that the auger drive motor should run in order to convey the ashes from hopper 204 to the external conveyor. This period may, for example, be a much shorter period than the time set on section 212*a*, and this interval may be on the order of thirty to ninety seconds.

It will thus be apparent that when timer section 212*a* "times out" (for example at the end of twelve hours from the time it is manually set), the circuit is completed through section 212*b* to energize the auger motor 208. The motor remains energized to operate the ash discharge conveyor until section 212*b* "times out" at the end of the interval set on it (for example, the thirty to ninety seconds chosen).

The times at which section 212*a* operates can advantageously be chosen to coincide with times during which the probability of hot ashes being in the hopper is minimized. This holds to a minimum any inconvenience or danger which may be associated with the ash removal operation. The ash receptacle can obviously be emptied as desired.

It will be understood that the timer 212, the motor 208 and the lines electrically coupling these components into the circuitry as shown in FIG. 8 need only be included as a part of the circuitry in the event the optional automatic ash removal conveyor system of FIG. 10 is included as a part of the furnace. Otherwise, these items may omitted.

Having thus described the invention, I claim:

1. A log burning furnace comprising:

a combustion chamber;

storage means proximal the chamber for storing a supply of wood log fuel for the furnace;

means at least partially in the chamber for sensing the presence of a quantity of log fuel and for generating a signal responsive to said quantity reaching a predetermined minimum amount;

log feeder means operably associated with the chamber and the storage means respectively for conveying logs individually into the chamber, said feeder means being operably coupled with the sensing means for automatically feeding a log into the chamber responsive to the generation of said signal by the sensing means means in the chamber for supporting said logs, said support means including a grate, means mounting said grate for vertical shifting movement, and spring means operably coupled with the grate biasing the latter toward the upper end of its path of travel, and wherein said sensing means includes an electrical switch operating means mounted for engagement by the grate in disposition to initiate said signal when the weight of logs on the grate falls below a level sufficient to maintain the grate below a predetermined position proximal the uppermost end of its path of travel, said switch operating means includes structure for operating the switch to deenergize the feeder means when the grate reaches a position spaced vertically below said predetermined position.

2. The furnace of claim 1, wherein said storage means includes an inclined ramp adapted to support said logs in position for rolling movement under the influence of gravity toward an end of the ramp, and wherein said feeder means includes an elongated receiver in disposition adjacent the end of the ramp to catch a log rolling therefrom, and means operably associated with the receiver for pushing a log endwise from the receiver into the combustion chamber.

3. The furnace set forth in claim 2, wherein is included releaseable stop means operably associated with the ramp for holding said logs against said rolling movement, and means operably coupling said stop means with the sensing means to operate the stop means to release a log for movement to the receiver responsive to said signal indicating a low fuel supply in the chamber.

4. A furnace as set forth in claim 3, wherein said stop means includes a pair independently operated barriers extending into the path of travel of logs rolling down said ramp, one of said barriers being spaced upwardly of the ramp from the other barrier a sufficient distance to receive and hold a log therebetween, said barriers being movable to standby positions permitting logs to roll down the ramp.

5. The furnace as set forth in claim 2, wherein said pushing means includes an elongated, rigid element, means mounting the element in disposition extending into the receiver and adapted to engage an end of a log therein, and means for moving the element on a reciprocable path of travel longitudinally of the receiver to push a log from the receiver into the chamber.

6. The furnace as set forth in claim 5, wherein said chamber includes a wall adjacent an end of the receiver, there being an aperture in the wall adapted for the passage of a log endwise therethrough, and wherein is provided yieldable door means normally closing said aperture, said door means including structure adapted to be engaged by a log as the latter is pushed from the receiver, said structure yielding under the influence of the movement of the log to provide sufficient opening for passage of the log through the wall.

7. The furnace as set forth in claim 6, wherein said structure includes a sheet of relatively flexible material secured to the wall in covering relationship over the aperture, said sheet being cut in a manner to present a plurality of bendable flaps extending across the aperture.

8. The furnace as set forth in claim 6, wherein said structure includes a door hingedly mounted on the wall, and spring means operably coupled with the door for biasing the latter to a closed position over the aperture, said spring means being adapted to yield when the door is engaged by a log to swing the door from said covering relationship to permit movement of the log from the receiver through the aperture and into the chamber.

9. The furnace as set forth in claim 1, wherein is included gas burner means in the chamber and operably coupled with a source of gas fuel, whereby to permit operation of said furnace with gas fuel as may be desired in the event of an inadequate supply of wood log fuel.

10. The furnace as set forth in claim 9, wherein the gas burner being mounted in the chamber in vertically spaced relationship above the grate, and wherein is included deflector means in the chamber interposed between the grate and the gas burner in disposition to shield the latter from fouling by the products of combustion emanating from burning logs on the grate.

11. The furnace as set forth in claim 1, wherein said chamber has a bottom provided with an opening therethrough for the passage of ash through the opening, and wherein is provided a removable ash receptacle beneath said opening to receive ashes gravitating from the chamber.

12. The furnace as set forth in claim 11, wherein is provided rollers carried by the receptacle and supporting the latter to facilitate removal of the receptacle for ash disposal.

13. The furnace as set forth in claim 1, wherein is included heat exchange means in fluid communication with the combustion chamber in disposition to be engaged by air to be heated by the furnace, said heat exchange means including a manifold adapted to be coupled with a flue for venting gaseous products of combustion to the atmosphere, a plurality of tubular conduits communicating the manifold with the combustion chamber, and damper means at the outlet end of the manifold for controlling the rate of discharge of said gaseous combustion products to the flue.

14. The furnace as set forth in claim 13, wherein is included fan means for moving said air to be heated by the furnace across the outer surfaces of said manifold and said conduits whereby the air is heated by the heat exchanger.

15. The furnace as set forth in claim 1, wherein said chamber has a bottom provided with an opening therethrough for the gravitation of ash through the opening;

a hopper beneath the opening to receive the ashes from the chamber;

an electrically operable conveyor in communication with said hopper for conveying the ashes from the hopper to a point external of the latter; and control means operably coupled with the conveyor and a source of electrical energy for energizing the conveyor to remove the ashes from the hopper.

16. The furnace as set forth in claim 15, wherein said control means includes timer means operable to cause the energizing of the conveyor at preselected time intervals.

17. The furnace as set forth in claim 15, wherein said timer means includes a pair of timer sections, each section being selectively adjustable independently to operate at different time periods, said timer sections being interposed in series in an electrical circuit with the conveyor for energizing the latter when both timers are operated in accordance with intervals which are manually set on the respective timer sections.

* * * * *